United States Patent [19]

Fraley et al.

[11] 4,200,232

[45] Apr. 29, 1980

[54] INDUCED AIR FLOW SELF-CLEANING SPRAY NOZZLE

[75] Inventors: Jack E. Fraley, Spokane, Wash.; Earl F. Sommers; Shorter Strang, both of Winter Haven, Fla.; W. C. McConnell, Whitmore Lake, Mich.

[73] Assignee: The United States of America as represented by the Secretary of the Interior, Washington, D.C.

[21] Appl. No.: 954,026

[22] Filed: Oct. 23, 1978

[51] Int. Cl.[2] ..... B05B 1/28; B05B 7/00; B05B 15/02

[52] U.S. Cl. ..... 239/112; 239/290; 239/422; 239/425.5

[58] Field of Search ..... 239/104, 106, 112, 290, 239/422, 423, 424, 424.5, 425.5; 366/11

[56] References Cited

U.S. PATENT DOCUMENTS 3,471,263 10/1969 Hojnos et al. ..... 239/424 X

FOREIGN PATENT DOCUMENTS 553672 1/1957 Belgium ..... 239/424.5

OTHER PUBLICATIONS

RI8266, Fraley, Jack E., Dry-Process-Sprayed Coal Mine Sealants, An Updated Progress Report, Bureau of Mines, Nov. 1978.

*Primary Examiner*—Andres Kashnikow

*Attorney, Agent, or Firm*—Thomas Zack; Donald A. Gardiner

[57] ABSTRACT

A spray nozzle which is non-plugging and selfcleaning. The nozzle has a central main conduit with an externally mounted water discharge assembly encircling it at its front opened end. A mixture of air and a sealant is forced through the main conduit until it is expelled from the conduit's inwardly tapered front opened discharge end. The water discharge assembly, in the preferred embodiment, has two spaced concentric rings joined together. The rearmost ring serves to mount the assembly to the main conduit and to support a second ring having an internal hollow water conduit section. Near the discharge front end, the front ring is attached to the rear ring by several supporting mounts. The front or outer ring has a plurality of water discharge jets or openings which encircle the front of the main conduit and are fed through their internal hollow section by a water conduit. A tapered surface of the outer ring which faces towards the main conduit cooperates with the gradually tapered outer surface of the main conduit to form an air passage therebetween which encircles the discharge end. As the air-sealant mixture is forced through the main conduit, an air flow is induced in the air passage by the air flow in the main conduit. This induced air flow is between the main conduit and the front ring. This induced air flow serves to remove externally mixed material from the nozzle before the same falls on the water jets.

5 Claims, 2 Drawing Figures

13
d
3
23
18
13
11
18
23
5
θ
21
7
19
INDUCED
AIR FLOW
19
9
15
1
17
WATER
INLET
SEALANT
HOSE
AIR PLUS SEALANT 17
19
11
15
13
5
3
21
1
13
9
19

INDUCED AIR FLOW SELF-CLEANING SPRAY NOZZLE

BACKGROUND OF THE INVENTION

1. Field of the Invention

Our invention relates to spray nozzles which are nonplugging and/or self-cleaning.

2. Description of the Prior Art

The prior nozzle art teaches it is old to provide a set of holes around an inner tube. In the U.S. Pat. No. 3,460,764 (Wallis) such an arrangement is disclosed in which air is supplied to the holes to control divergence of the coating particles from the inner tube and to produce a protective air stream. The U.S. Pat. Nos. 3,364,970 and 3,484,044 (both to Dombruch et al) show a center oxygen stream with a high velocity which induces the gas in an intermediate stream to flow towards the outer periphery of the center stream. Other United States patents of interest include U.S. Pat. Nos. 743,777 (Tucker et al), 1,991,894 (Forney), and 2,881,826 (Spies).

What the known prior art does not disclose is a simple and effective selfcleaning non-plugging spray nozzle having an inner nozzle conduit with an externally mounted fluid ring having holes therein, wherein a narrow space between the ring mount and the inner nozzle conduit induces an air flow to clean the nozzle.

The invention described herein was disclosed in the United States Bureau of Mines Report of Investigation (RI) 8266 entitled "Dry-Process Sprayed Coal Mine Sealants, An Updated Progress Report" first published in Nov. 17, 1977 and authored by Jack E. Fraley. The contents of this report are specifically incorporated by reference herein.

SUMMARY OF THE INVENTION

The spray nozzle forming the subject matter herein relates to a main central material coating conduit with a fluid spray assembly mounted on it near its discharge end opening. The spraying assembly has a series of discharge holes facing in the same direction as the main conduit opening and encircling it. The front discharge section of the main conduit is gradually tapered so that it narrows down towards the opened end. Between the tapered front end of the main conduit and the closest inner side surface of the spray assembly there is formed a space which encircles the main conduit. An airflow is induced through this space as air discharges occur at the main conduit. This induced airflow acts to clean the nozzle and prevent plugging by externally mixed material.

The primary object of the invention is an improved self-cleaning non-plugging spray nozzle.

BRIEF DESCRIPTION OF THE DRAWINGS

Although FIG. 1 is a schematic representation of how the preferred embodiment (FIG. 2) would work, corresponding parts have been given the same numbers for ease in understanding the invention. The main conduit 1, as illustrated in FIG. 1, is a hollow elongated cylinder through which the coating material to be sprayed is forced. Generally the conduit is of a uniform diameter along its entire length until it nears the area located immediately before the material discharge opened end 3. Near the discharge end the conduit's surface gradually tapers down in the area 5 from its uniform diameter to a narrower diameter until it terminates at the discharge end. Mounted on the conduit by set screws or the like at the area just before the taper begins and extending until coplanar with opening 3 is the water ring assembly 7. Essentially the ring assembly has an inner mounting ring 9 and an outer water ring 11 having a plurality of water discharge holes 13 therein. A small water hose 15 with appropriate control valving 17 supplies water to the internal hollow portion 18 of the outer ring for discharge through its holes. The inner mounting ring has a series of support members 19 to rigidly hold the outer ring thereto. The inner ring also serves to support the water hose which extends traversely through it. Located between the front sections of the surface 5 of the main conduit near its discharge opening and the nearest inner surface 23 of the water ring is a space 21 which is generally circular in shape when viewed from the front in the direction (FIG. 1) of the arrow. This restricted opening serves the function of inducing an air flow, in the FIG. 1 direction shown, as rapidly flowing air is discharged from opening 3 in the form of an air and sealant mixture.

It is critical to the operation of our invention to note the function and shape of the space 21. The schematic of FIG. 1 would correspond to a cross-sectional top view of the nozzle with the flow of air, water, and material being from the figure's bottom towards the top. As viewed frontally in the direction of the arrow in FIG. 1, the space 21 would be a ringed area whose boundaries are the circular edge formed by the outer surface of the tapered front end of conduit 1 and the circular front edge of surface 23 which is the nearest part of the ring 11 to the main conduit. Each boundary would thus appear to be a circle concentric with the center of the circle forming opening 3. FIG. 2 more clearly shows this disclosed relationship.

Figure 1:
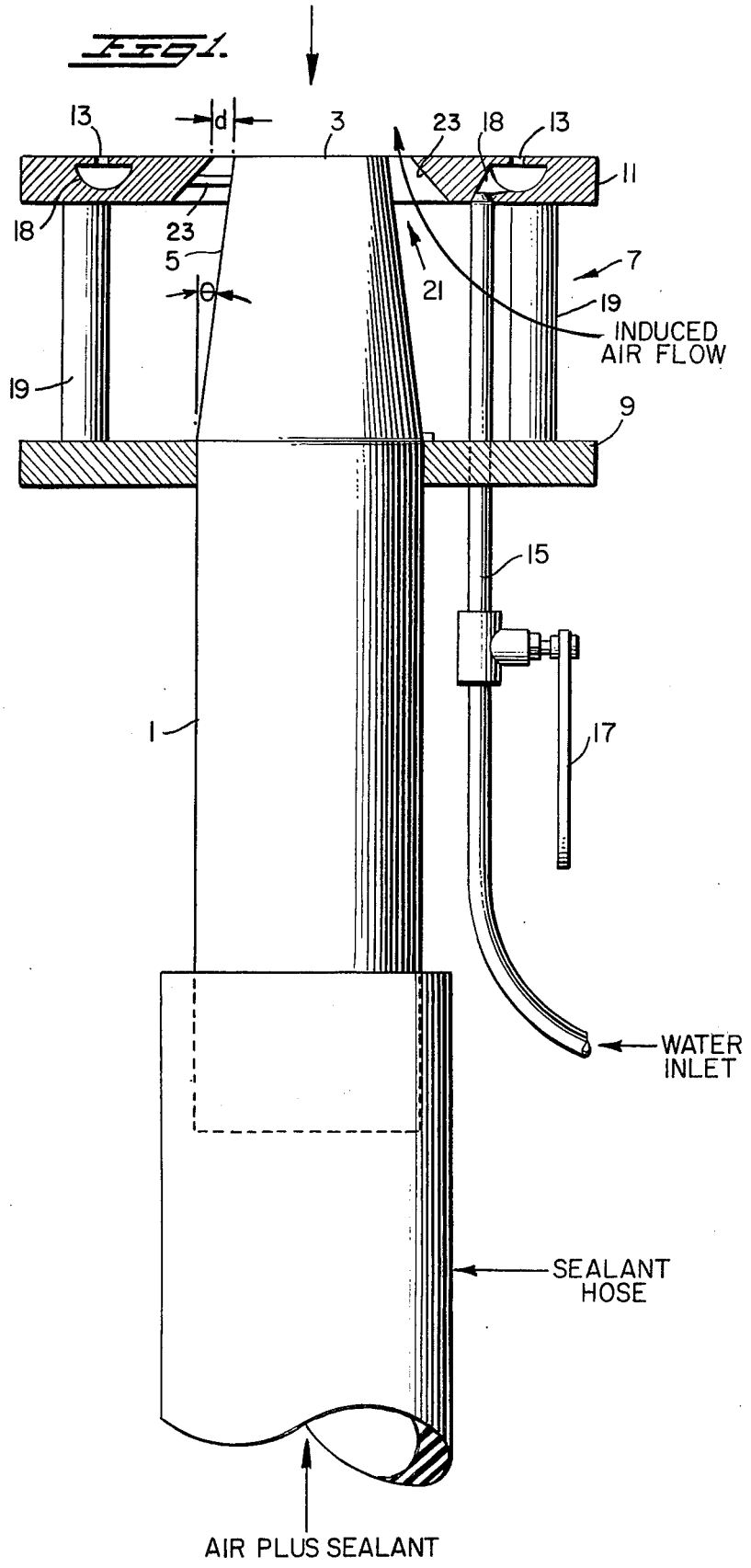
FIG. 1 schematically shows how the invention would be used with the preferred embodiment thereof.
Figure 2:
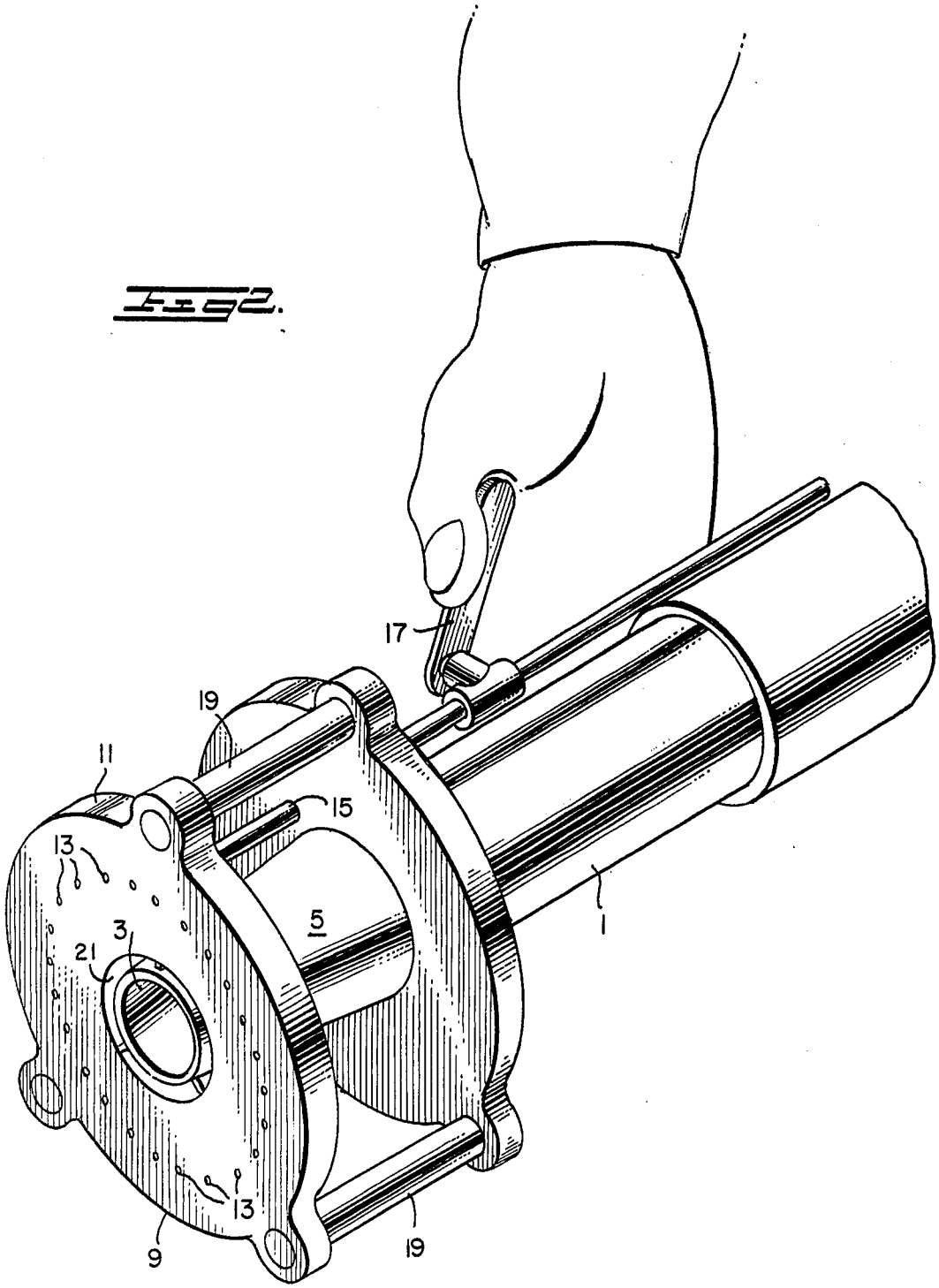
FIG. 2 is a perspective view of the preferred embodiment of the invention showing how it can be operated.

The preferred embodiment of the schematic of FIG. 1, FIG. 2, shows the externally mounted water ring with thirty-two equally spaced holes 13 which provide external mixing of water and sealant downstream of the conduit 1. The inwardly tapered surface 5 eliminates material from clinging to the inside of the cylinder just behind the tip. And the induced air flow through space 21 removes mixed material (water, sealant and air) that hangs to the conduit tip before it can fall on the water jets 13.

The illustrated (FIG. 2) preferred embodiment was designed to pneumatically transport dry (sealant) material to the water-adding nozzle to provide external mixing and dust-free spraying without plugging the nozzle and at the same time be self-cleaning. The material was used in a coal mine to reduce shale sloughing in areas sensitive to weathering from varying moisture-temperature cycles. Mixing external to the equipment was selected to eliminate the problems commonly associated with internal mixing such as plugging of pumps and/or lines, cleanup, etc. For the particular purpose mentioned, the sealant was a medium-sized mineral wool nodule about 0.75 of an inch long. Additional modifications to the machinery used can be found on pages 2–4 of the referenced RI. Although optimum design characteristics have not been firmly established they can be easily determined by routine testing. Very satisfactory results have been obtained when the angle $\theta$ was 30 degrees or less and the distance "d" was less than ¼-inch. Variations therefrom are contemplated and well within the scope of our invention. Using the preferred embodiment of the invention for one five hour spray period resulted in the following performance characteristics therefore:

Table 1

| | | |
|---|---|---|
| Bag Weight of Sealant | 50 | lbs. |
| Spray rate in bags per hour | 35 | |
| Spray coverage in sq. ft. per bag at .5 in | 32 | |
| Coverage rate in sq. ft. per hr. at .5 in | 1,120 | |
| Sealant Coverage in lbs/sq. ft. at .5 in | 1.56 | |
| Water rate in lbs per minute | 56 | |
| Water-sealant ratio in lbs/1.00 lb. | 1.92 | |

Other uses sprayed materials, configurations, and spray rates, etc. are, of course, possible with this invention. Thus, although the invention has been described in detail with respect to an exemplary use and embodiment thereof, it will be understood by those skilled in the art that variations and modifications may be effected within the scope and spirit of the claims that follow.

We claim:

1. A spray nozzle adapted to spray a gas-material mixture and a fluid which externally mixes therewith comprising:

an elongated main conduit with a discharge end for transporting the gas-material mixture towards the discharge end, said conduit's outer surface being tapered in cross-sectional diameter near said discharge end;

a fluid spraying assembly mounted on said main conduit near its discharge end, said assembly having a frontal housing with a ring having plurality of fluid discharge openings located in the ring around the main conduit's discharge end, said housing being spaced from the tapered surface of said main conduit so as to form an opened space between the discharge openings and main conduit and around the main conduit's discharge end, said assembly also having a rear mounting housing for mounting the assembly to the main conduit and at least two support members spaced from each other so that air may freely pass therebetween, said support members rigidly holding the front ring to the rear mounting housing;

means for supplying a fluid under pressure to the fluid openings for discharging the fluid; and means for supplying a material-gas mixture through said conduit to thereby induce an airflow through said opened space around the main conduit.

2. The nozzle of claim 1 wherein the front housing of said fluid assembly has a fluid conduit portion therein to provide a flow path to the discharge openings from said means for supplying a fluid.

3. The nozzle of claim 1 wherein said rear mounting housing is a second ring substantially identical in outside diameter to the frontal ring and generally parallel thereto, said second ring having means for holding the means for supplying a fluid.

4. The nozzle of claim 1 wherein said front housing ring has an inner and outer diameter, the inner diameter having a tapered portion in cross-section with said tapered portion forming one of the limits for defining the opened space with said tapered surface of the main conduit defining the other limit.

5. The nozzle of claim 1 wherein said means for supplying fluid is a valve controlled hose attached to said fluid spray assembly at its front housing and wherein said assembly is mounted to the main conduit.

* * * * *